US010310432B2

(12) United States Patent
Uchiyama et al.

(10) Patent No.: US 10,310,432 B2
(45) Date of Patent: Jun. 4, 2019

(54) IMAGE FORMING APPARATUS

(71) Applicant: CANON KABUSHIKI KAISHA, Tokyo (JP)

(72) Inventors: Takahiro Uchiyama, Mishima (JP); Toshiya Kaino, Suntou-gun (JP); Kuniaki Kasuga, Mishima (JP); Taisuke Minagawa, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/839,921

(22) Filed: Dec. 13, 2017

(65) Prior Publication Data

US 2018/0164729 A1 Jun. 14, 2018

(30) Foreign Application Priority Data

Dec. 14, 2016 (JP) ..... 2016-242008

(51) Int. Cl.
*G03G 15/00* (2006.01)
*G03G 15/20* (2006.01)

(52) U.S. Cl.
CPC ..... *G03G 15/553* (2013.01); *G03G 15/2064* (2013.01); *G03G 15/2039* (2013.01)

(58) Field of Classification Search
CPC ..... G03G 15/55; G03G 15/553; G03G 15/2039–15/205; G03G 15/2078; G03G 15/2082
See application file for complete search history.

(56) References Cited

U.S. PATENT DOCUMENTS

2017/0060051 A1* 3/2017 Tamaki ..... G03G 15/553

FOREIGN PATENT DOCUMENTS

| | | | |
|---|---|---|---|
| JP | 2005115221 A | | 4/2005 |
| JP | 2007212844 A | | 8/2007 |
| JP | 2009075375 A | * | 4/2009 |
| JP | 2010211087 A | * | 9/2010 |
| JP | 2012053332 A | | 3/2012 |

OTHER PUBLICATIONS

Machine Translation of Inoue (JP 2010-211087). Sep. 24, 2010.*
Machine Translation of Sakamoto et al. (JP 2009-075375). Apr. 9, 2009.*

* cited by examiner

*Primary Examiner* — Carla J Therrien
(74) *Attorney, Agent, or Firm* — Rossi, Kimms & McDowell LLP

(57) ABSTRACT

An image forming apparatus includes an image forming portion for forming an image on a sheet; a fixing portion for fixing the image on the sheet, the fixing portion including first and second rotatable members cooperative with each other to form a nip, wherein the sheet carrying a toner image is subjected to a fixing process by passing through the nip so that the toner image is fixed on the sheet; an acquiring portion configured to acquire information relating to remaining service life of each area provided by dividing the first rotatable member into a plurality of areas in a longitudinal direction of the first rotatable member; and a notifying portion configured to notify a remaining service life of the fixing portion or the image forming apparatus in accordance with the information acquired by the acquiring portion.

7 Claims, 8 Drawing Sheets

IMAGE FORMING APPARATUS

FIELD OF THE INVENTION AND RELATED ART

The present invention relates to an image forming apparatus and a fixing device mountable in an image forming apparatus, such as a laser beam printer, an LED printer, a digital copying machine, or the like, which employs an electrophotographic image forming method, an electrostatic recording method, or the like.

There are various methods for determining the length of the residual life span of a fixing device. One of such methods is disclosed in Japanese Laid-open Patent Application No. 2005-115221. According to this patent application, the fixing device is provided with a temperature sensor for detecting the temperature of the lengthwise end portions of its fixing member, with respect to the direction perpendicular to the direction in which a sheet of recording medium is conveyed through the fixing device, in order to measure the length of time the temperature of the lengthwise end portions of its fixation roller is higher than a preset level. As this measured length of time reaches a preset value, it is determined that the fixing member has reached the end of its life span.

The method disclosed in this patent application, however, is problematic for the following reason. That is, in the case of this method, it is only the temperature of one of the lengthwise ends of the fixation roller that is used to determine the length of the residual life span of the fixation roller. In other words, the temperature of the other portions of the fixation roller are not taken into consideration to determine the length of the residual life span of the fixation roller. Thus, it was difficult to accurately determine the length of the residual life span of the fixation roller. More concretely, the temperature of the lengthwise end portions of the heating member as a fixing member, and that of the pressing member as a fixing member, are affected by the size of a sheet of recording medium used for image formation. Further, the amount by which the lengthwise end portions of a fixing member is frictionally worn (deteriorated) is affected by the cumulative length of time the fixing member has been actually in operation (has been rotated while being heated). Thus, the amount by which the lengthwise end portions of a fixing member is frictionally worn (deteriorated) is affected by the size of a sheet of recording medium used for image formation.

For the reason given above, if the method for determining the length of residual life span of a fixing member based solely on the temperature of one of the lengthwise end portions of the fixing member, which is disclosed in Japanese Laid-open Patent Application No. 2005-115221, is used to determine the length of the residual life span of a fixing member, there occurs sometimes that the actual state of frictional wear of the heating member and/or pressing member is different from the state of frictional wear of the heating member and/or pressing member, determined based on the method disclosed in the abovementioned patent application.

SUMMARY OF THE INVENTION

According to an aspect of the present invention, there is provided an image forming apparatus comprising an image forming portion configured to form an image on a recording material; a fixing portion configured to fix the image on the recording material, said fixing portion including a first rotatable member and a second rotatable member cooperative with said first rotatable member to form a nip, wherein the recording material carrying a toner image is subjected to a fixing process by passing through the nip so that the toner image is fixed on the recording material; an acquiring portion configured to acquire information relating to remaining service life of each area provided by dividing said first rotatable member into a plurality of areas in a longitudinal direction of said first rotatable member; and a notifying portion configured to notify a remaining service life of said fixing portion or said image forming apparatus in accordance with the information acquired by said acquiring portion.

Further features of the present invention will become apparent from the following description of exemplary embodiments with reference to the attached drawings.

DESCRIPTION OF THE EMBODIMENTS

Hereinafter, a few of preferred embodiments of the present invention are described in detail with reference to appended drawings.

Embodiment 1

(Image Forming Apparatus)

Figure 2:
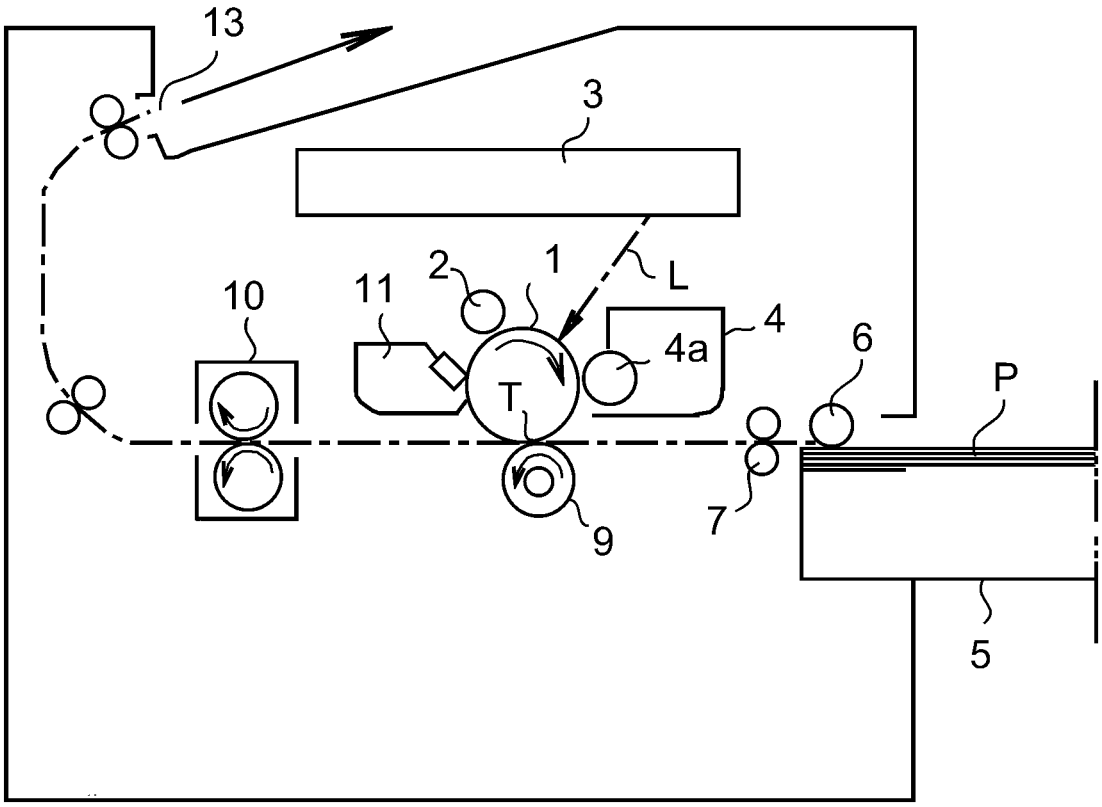
FIG. 2 is a schematic sectional view of an image forming apparatus which employs the fixing device in the first embodiment of the present invention; it shows the general structure of the apparatus.

To begin with, referring to FIG. 2, the image forming apparatus having the fixing device in this embodiment is described about its general structure. This image forming apparatus is a laser beam printer which uses one of electrophotographic processes. A referential code 1 stands for a photosensitive drum as an image bearing member, which is rotationally driven in the direction (clockwise direction) indicated by an arrow mark at a preset peripheral velocity (process speed). A referential code 2 stands for a charging means of the contact type, such as a charge roller, which uniformly charges (primary charge) the peripheral surface of the photosensitive drum 1 to preset polarity and potential level.

A referential code 3 stands for a laser beam scanner as an exposing means, which scans (exposes) the charged peripheral surface of the photosensitive drum 1 with a beam L of laser light which it outputs while modulating (turning on or off) the beam L according to the electrical digital signals which reflect the information of the image to be formed, and which are inputted from an external device. Thus, electrical charge is removed from exposed portions of the peripheral surface of the photosensitive drum 1. Consequently, an electrostatic latent image, which reflects the information of the image to be formed, is effected on the peripheral surface of the photosensitive drum 1. A referential code 4 stands for a developing apparatus having a developing sleeve 4*a*, from which developer (toner) is supplied to the peripheral surface of the photosensitive drum 1. As the peripheral surface of the photosensitive drum 1 is supplied with the developer, the electrostatic latent image on the peripheral surface of the photosensitive drum 1 is developed into a transferable toner image, from its upstream side in terms of the rotational direction of the photosensitive drum 1.

A referential code 5 stands for a sheet feeder cassette, in which multiple sheets P of recording medium are stored. As a feed roller 6 is driven, the sheets P in the cassette 5 are fed one by one into the main assembly of the image forming apparatus by the feed roller 6 while being separated from those in the cassette 5. Then, each sheet P is conveyed between a pair of registration rollers 7, and is introduced into a transferring portion T, which is between the photosensitive drum 1, and a transfer roller 9 as a transferring member, with preset timing.

As a sheet P of recording medium is introduced into the transferring portion T, it is conveyed through the transferring portion T while remaining pinched between the photosensitive drum 1 and transfer roller 9. While the sheet P is conveyed through the transferring portion T, transfer voltage (transfer bias) is applied to the transfer roller 9 from an unshown transfer bias application power source, while being controlled in a preset manner. As the transfer bias, which is opposite in polarity from the toner (toner image), is applied to the transfer roller 9, the toner image on the peripheral surface of the photosensitive drum 1 is electrostatically transferred onto the surface of the sheet P, in the transferring portion T. After the transfer of the toner image onto the sheet P in the transferring portion T, the sheet P is separated from the peripheral surface of the photosensitive drum 1. Then, the sheet P is conveyed to a fixing device 10, and introduced into the apparatus 10, in which the toner image is fixed to the sheet P by the application of heat and pressure to the sheet P and the toner image thereon.

After the separation of the sheet P of recording medium from the peripheral surface of the photosensitive drum 1 (after transfer of toner image onto sheet P), the peripheral surface of the photosensitive drum 1 is cleaned by a cleaning apparatus 11 (toner, paper dust, etc., remaining on peripheral surface of photosensitive drum 1 are removed by cleaning apparatus 11) so that the peripheral surface of the photosensitive drum 1 can be repeatedly used for image formation. After being conveyed through the fixing device 10, the sheet P is discharged from the image forming apparatus through the sheet discharge opening 13 of the image forming apparatus.

(Fixing Device)

Figure 3:
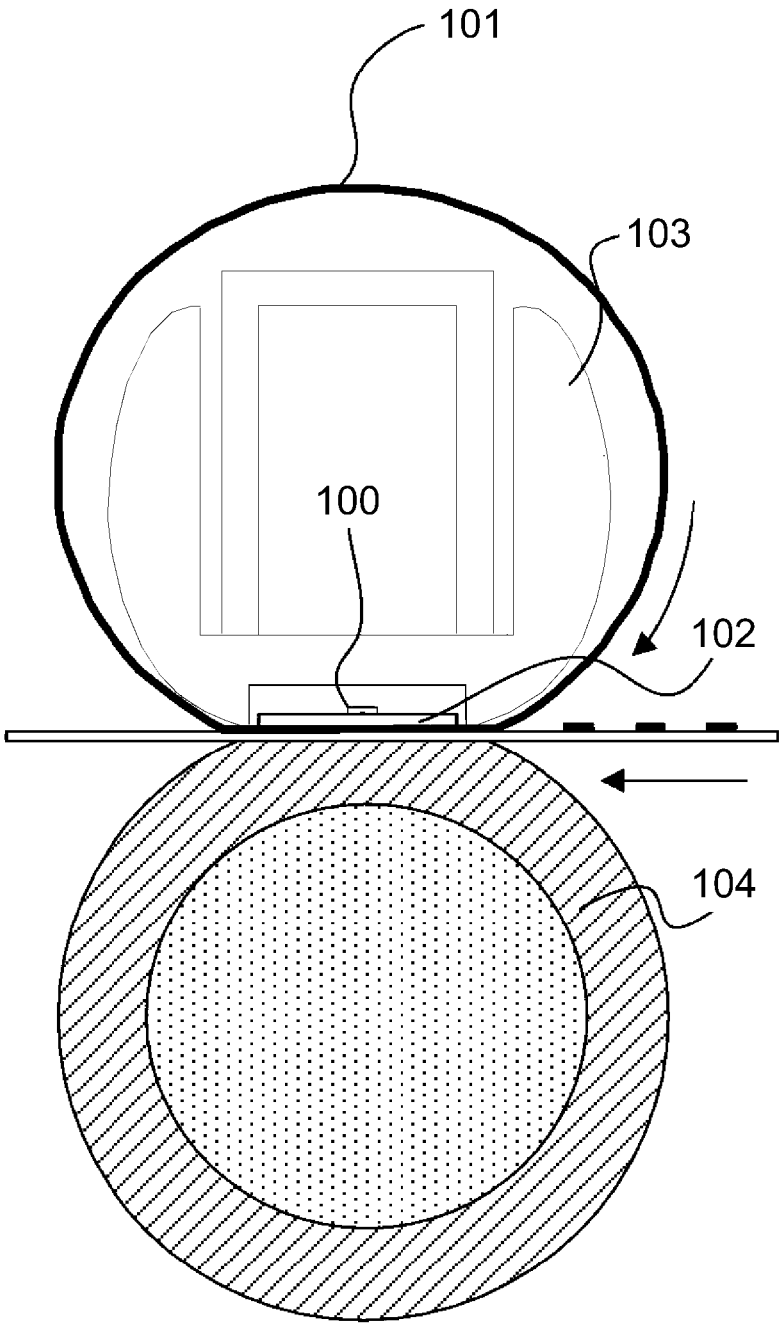
FIG. 3 is a schematic sectional view of the fixing device in the first embodiment, at a plane which is perpendicular to the lengthwise direction of the apparatus.

Next, referring to FIG. 3, the fixing device (fixing device) in this embodiment of the present invention is described. FIG. 3 is a schematic sectional view of the fixing device in this embodiment. The fixing device is of the so-called film heating type, and also, of the so-called tensionless type. That is, it is provided with a rotational heating film, and a rotational pressure application member. It is the rotational pressure application member that is rotationally driven. In this specification, the direction which is perpendicular to the direction in which a sheet of transfer medium (recording medium) is introduced into, and conveyed through, the fixing device, is referred to as the "lengthwise direction".

A referential code 101 stands for a heating film (rotational member, endless belt) as a fixing member (heating member). The heating film 101 is cylindrical (endless; it is in the form of a cylinder). It is made up of a cylindrical film, and an elastic layer which is formed on the cylindrical film. A referential code 104 stands for a pressure roller as a pressure applying member, which also is a fixing member (which opposes heating film 101). A referential code 103 stands for a heater holder as a member for holding heating member. The heater holder 103 is in the form of a trough which is roughly semicircular in cross-section. It is heat resistant and rigid. A referential code 102 stands for a heater as a heat source, which is disposed on the bottom surface of the heater holder 103 in such an attitude that it extends in the lengthwise direction of the heater holder 103. The heating film 101 is loosely fitted around the heater holder 103.

The heater holder 103 is formed of highly heat resistant liquid polymer. It plays the role of holding the heater 102, and also, the role of guiding the heating film 101. In this embodiment, the liquid polymer used as the material for the heater holder 103 in this embodiment is Zenite 7755 (commercial name; product of DuPont Co., Ltd.). The highest temperature level which the Zenite 7755 can withstand is roughly 270° C.

The pressure roller 104 is made up of a metallic core formed of stainless steel, a roughly 40 μm thick layer of silicone rubber formed on the peripheral surface of the metallic core, and a roughly 40 μm thick piece of resinous tube fitted around the layer of silicone rubber. The pressure roller 104 is rotatably disposed between the rear and front plates of the unshown frame of the image forming apparatus; the lengthwise end portions of the metallic core of the pressure roller 104 are rotatably supported by the front and rear plates.

It is on the top side of the pressure roller 104 that a heating film unit made up of the heater 102, the heater holder 103, the heating film 101, etc., are disposed in such an attitude that the heat faces downward, in parallel to the pressure roller 104. Further, the fixing device is structured so that each of the lengthwise end portions of the heater holder 103 remains under 98 N of pressure (10 kgf) applied by an unshown pressure application mechanism (heater holder 103 remains under total pressure of 196 N (20 kgf)). Thus, the downwardly facing surface of the heater 102 is kept pressed against the pressure roller 104 with the presence of the heating film 101 between the heater 102 and pressure roller 104. Therefore, a fixation nip (nip) having a preset amount of internal pressure, which is necessary for thermal fixation, is formed and maintained between the heating film 101 and pressure roller 104, since the pressure roller 104 is provided with the aforementioned elastic layer.

A referential code 100 stands for a thermistor as a temperature detecting means, which detects the temperature of the heater 102 by being placed in contact with the heater 102. The thermistor 100 is in connection to a control circuit portion (CPU) through an unshown A/D converter. The control circuit portion controls the heater 102 in temperature based on the output of the thermistor 100; it controls the power supply to the heater 102 with the use of a heater driving circuit portion.

The pressure roller 104 is rotationally driven by a driving means (unshown) at a preset peripheral velocity. As the pressure roller 104 is rotationally driven, friction occurs between the peripheral surface of the pressure roller 104 and the outwardly facing surface of the heating film 101, and therefore, rotational force is applied to the cylindrical heating film 101 by the pressure roller 104. Thus, the heating film 101 is rotated around the heater holder 103 by the pressure roller 104 in the direction indicated by an arrow mark, with the inward surface of the heating film 101 sliding on the downwardly facing portion of the surface of the heater 102. The inward surface of the heating film 101 is coated with grease to minimize the friction between the heater holder 103 and inwardly surface of the heating film 101 so that the heating film 101 easily slides on the heater holder 103.

As the pressure roller 104 is rotationally driven, the cylindrical heating film 101 is rotated by the pressure roller 104. Further, the power is supplied to the heater 102 so that the temperature of the heater 102 is increased to a preset level, and is kept at the preset level. Then, while the heating film 101 is rotated, and the temperature of the heater 102 is kept at the preset level, a sheet of recording medium, on which an unfixed toner image is present, is introduced into the nip, that is, between the heating film 101 and pressure roller 104.

Then, the sheet P of recording medium is conveyed along with the heating film 101 through the nip, while remaining pinched between the pressure roller 104 and heating film 101, with the surface of the sheet P of recording medium, on which the toner image is present, being kept airtightly in contact with the outward surface of the heating film 101. While the sheet P is conveyed through the nip, remaining pinched between the heating film 101 and pressure roller 104, the heat from the heater 102 is transmitted to the sheet P through the heating film 101. Thus, the unfixed toner image on the sheet P is heated and pressed. Consequently, the unfixed toner image melts, and becomes fixed to the sheet P as it cools down.

The heating film 101 in this embodiment is made up of a 30 μm thick cylindrical endless belt (substrative belt) formed of SUS, a roughly 300 μm thick layer of silicone rubber (elastic layer) formed on the outward surface of the substrative belt, and a piece of 30 μm thick tube (outermost layer) formed of PFA resin laid on the outward surface of the elastic layer. The measured thermal capacity of the heating film 101, structured as described above, was $12.2\times10^{-2}$ J/cm$^{2}$·° C. (thermal capacity per 1 cm$^{2}$).

It is possible to use such resinous substance as polyimide as the material for the substrative layer of the heating film 101. However, from the standpoint of enabling the fixing device to quickly start up, a metallic substance such as SUS and nickel is preferable as the material for the substrative layer to polyimide, since these substances are roughly ten times larger in thermal conductivity than polyimide. In this embodiment, therefore, SUS, that is, a metallic substance, was used as the material for the substrative layer of the heating film 101.

As the material for the elastic layer of the heating film 101, such rubber that is relatively high in thermal conductivity is used to enable the fixing device to quickly start up. The rubber used as the material for the elastic layer in this embodiment was roughly $12.2\times10^{-1}$ J/cm$^{2}$·° C. in specific heat.

Further, the surface layer of the heating film 101 is formed of fluorine resin to make the outward surface of the heating film 101 nonsticky in order to prevent the phenomenon that toner adheres to the outward surface of the heating film 101, and then, transfers onto a sheet P of recording medium from the outward surface of the heating film 101. Moreover, by using a piece of PFA tube as the material for the outermost layer of the heating film 101, the elastic layer of the heating film 101 can be easily covered with a layer of fluorine resin which is uniform in thickness.

Generally speaking, the greater the heating film 101 in thermal capacity, the slower it is in the startup speed in terms of temperature, causing therefore the fixing device to be slower to start up. For example, it has been known that if it is wanted for the fixing device to start up in no more than one minute excluding the period in which the fixing device is kept on standby, the thermal capacity of the heating film 101 needs to be no more than roughly 4.2 J/cm$^{2}$·° C.

In recent years, various attempts have been made to reduce a fixing device in thermal capacity, in order to reduce a fixing device in the first print-out time. For example, the fixing device in this embodiment is structured so that when the image forming apparatus having the fixing device is started up while the temperature of the apparatus is the same as the room temperature, its heater 102 is supplied with roughly 1000 W of electric power so that it takes no more than 20 seconds for the temperature of the heating film 101 to increases to 190□C. The silicone rubber used as the material for the elastic layer of the heating film 101 in this embodiment is roughly $2.2\times10^{-1}$ J/cm$^{2}$·° C. in specific heat. Thus, the thickness of the elastic layer (rubber layer) has to be no more than 500 μm, and the thermal capacity of the heating film 101 has to be no more than $18.9\times10^{-2}$ J/cm$^{2}$·° C. In this embodiment, in order to obtain a high quality image, the silicon rubber layer (elastic layer) was no less than 200 μm, and the thermal capacity of the heating film 101 was to be $8.8\times10^{-2}$ J/cm$^{2}$·° C. That is, generally speaking, if it is desired to obtain a high quality image with the use of a fixing device which is similar in structure to the fixing device in this embodiment, the heating film 101 of the fixing device needs to be no more than 4.2 J/cm$^{2}$·° C. in thermal capacity. In this embodiment, therefore, such heating film that is no less than $8.8\times10^{-2}$ J/cm$^{2}$·° C. and no more than $18.9\times10^{-2}$ J/cm$^{2}$·° C. was used as the heating film 101, since it can satisfy both the objective of enabling an image forming apparatus (fixing device) to quickly start up, and the objective of enabling an image forming apparatus to form a high quality image.

(Method for Determining Length of Residual Life Span of Fixing Device)

Figure 1:
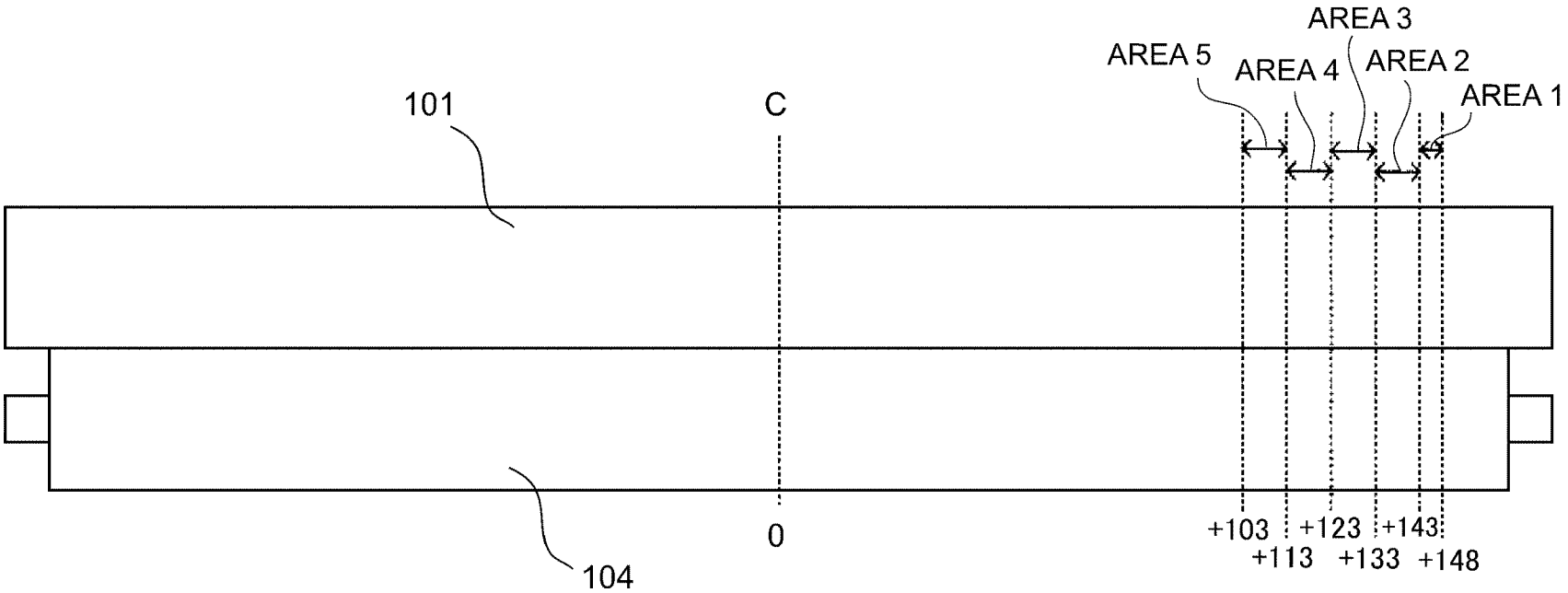
FIG. 1 is a schematic side view of the fixing device in the first embodiment of the present invention, as seen from the direction perpendicular to the lengthwise direction of the apparatus; it shows the general structure of the apparatus.

Referring to FIG. 1, in this embodiment, multiple sections of one of the lengthwise end portions the heating film 101, and those of the pressure roller 104, are designated as sections for determining the length of their residual life span (These sections will be referred to simply as "life span determination sections"). Further, such a value that indicates the state of the thermal deterioration attributable to the heating (fixing) operation of the fixing device is calculated for each section, and the length of the residual life span of each section is determined based on the value obtained through calculation.

FIG. 1 shows the life span determination sections which line up in the lengthwise direction of the fixing device. Referential codes 101 and 104 stand for heating film and a pressure roller, respectively. The maximum size of a sheet of recording medium which the fixing device in this embodiment is enabled to accommodate is A3. A referential code C stands for a positional referential line for recording medium conveyance. The line C coincides with the center of the heating film 101 and pressure roller 104 in terms of the lengthwise direction of the fixing device. That is, the fixing device is structured so that when a sheet of recording medium is conveyed for thermal fixation through the fixing device, the left and right sides of the sheet with reference to the line C are the same in dimension (width).

With respect to the lengthwise direction of the fixing device, the section 1 is between a point which is 143 mm from the referential line C and a point which is 148 mm from the referential line C. The section 2 is between a point which is 133 mm from the referential line C and a point 143 mm from the referential line C. The section 3 is between a point which is 123 mm from the referential line C and a point which is 133 mm from the referential line C. The section 4 is between a point which is 113 mm from the referential line C and a point which is 123 mm from the referential line C. The section 5 is between a point which is 103 mm from the referential line C and a point which is 113 mm from the referential line C.

Figure 4:
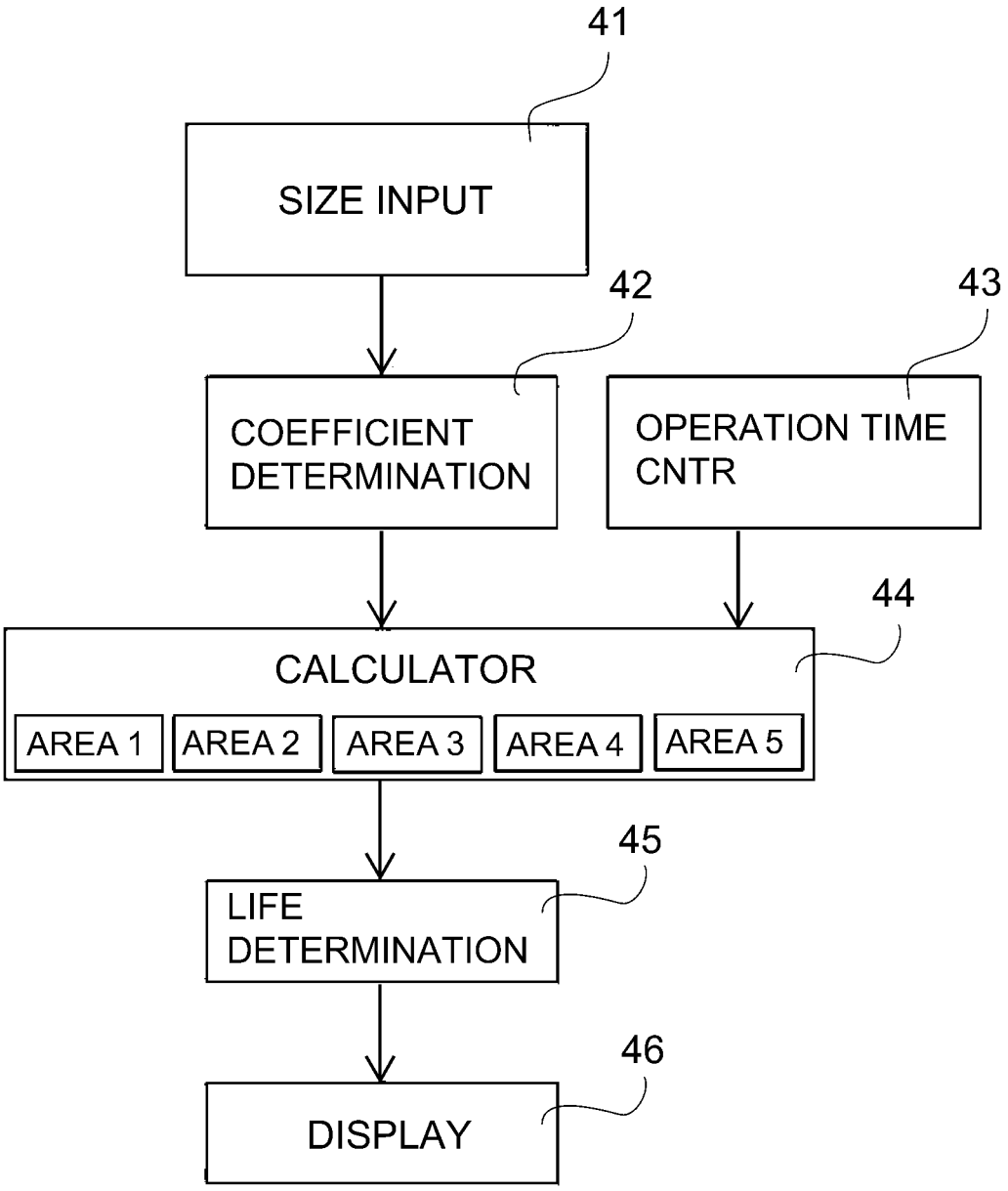
FIG. 4 is a block diagram of the means for determining the length of the residual life span of the fixing device, in the first embodiment of the present invention.

FIG. 4 is a block diagram of the means for determining the length of the residual life span of the fixing device, in this embodiment. A referential code 41 stands for a means for inputting recording medium size, that is, the means with which the image forming apparatus is provided so that the information such as recording medium size set by an operator with the use of the operation panel of an external apparatus such as a PC, or that of the image forming apparatus, can be inputted into the image forming apparatus. A referential code 42 stands for a means for selecting a coefficient to be used for calculating the cumulative length of the heating (fixing) operation of the fixing device, based on the recording medium size (information) sent from the recording medium size inputting means. A referential code 43 stands for a counter for cumulatively counting the length of time the fixing device is in a fixing operation, that is, the means for counting the length of time the motor for driving the pressure roller 104, as a pressing member, was driven.

A referential code 44 stands for a means for calculating the length of time the fixing device was in an fixing operation, that is, the means for calculating the cumulative length of time the fixing device was in a fixing operation, which indicates the length of time the heating means of the fixing device has been operated, based on the information obtained by the fixing device heating (fixing) operation duration coefficient selecting means 42 and heating (fixing) operation length counter 43. A referential code 45 stands for a means for determining the length of the residual life span of the fixing device, that is, the means for determining the length of the residual life span of the fixing device, based on the cumulative length of time the fixing device was in a fixing operation, calculated by the means 44. A referential code 46 stands for a means (informing portion) for displaying the length of the residual life span of the fixing device, that is, the means for informing a user that the length of time the fixing device was used exceed the expected life span of the fixing device, or reached the end of the expected life span of the fixing device. By the way, in a case where the image forming apparatus is structured so that its fixing device is not replaceable, the residual life span displaying means 46 informs a user of the residual life span of the image forming apparatus.

Next, the operation of the residual life span length determining means is described in detail. As an image forming operation is started, first, the recording medium size inputting means 41 outputs the recording medium size information to the heating (fixing) operation duration coefficient selecting means 42. Table 1, which shows the preset relationship among the recording medium size, sections 1-5, and heating (fixing) operation duration coefficients is stored in the heating (fixing) operation duration coefficient selecting means 42.

TABLE 1

| | Area 1 | Area 2 | Area 3 | Area 4 | Area 5 |
|---|---|---|---|---|---|
| | | | Sheet size | | |
| | 143-148 mm | 133-143 mm | 123-133 mm | 113-123 mm | 103-113 mm |
| A3-Portrait<br>A4-Landscape | 1.0 | 1.0 | 1.0 | 1.0 | 1.0 |
| LDR-Portrait<br>LTR-Landscape | 3.0 | 1.0 | 1.0 | 1.0 | 1.0 |
| EXE-Landscape<br>B4-Portrait<br>B5-Landscape | 2.0 | 3.0 | 1.0 | 1.0 | 1.0 |
| LGL-Portrait<br>LTR-Portrait<br>A4-Portrait<br>A5-Landscape | 1.0 | 2.0 | 3.0 | 1.0 | 1.0 |
| B5-Portrait<br>B6-Landscape | 1.0 | 1.3 | 3.0 | 3.0 | 1.3 |
| A5-Portrait<br>A6-Landscape | 1.0 | 1.0 | 1.3 | 3.0 | 3.0 |

The heating (fixing) operation duration coefficient for each of the five sections 1-5 are preset based on the recording medium size (relationship in size between sheet path and out-of-sheet path with respect to lengthwise direction) and temperature distribution of the out-of-sheet-path portion. It is presumed here that in a case where a sheet of recording medium (of size LTR, size A5, etc.) which is narrower than the widest sheet of recording medium which the fixing device can accommodate for thermal fixation, is conveyed through the fixing device for thermal fixation, the portions of the heating film 101, which are out of the sheet path, and those of the pressure roller 104, increase in temperature, since the heat given to these portions is not consumed for thermal fixation.

The out-of-sheet-path portions are not uniform in the amount by which they increase in temperature, because the amount by which each of the sections 1-5 increases in temperature is affected by the width of the sheet of recording medium which is conveyed through the fixing device. More concretely, in a case where a sheet of recording medium of the LTR size (279 mm in sheet path width) is conveyed in the landscape mode through the fixing device, the portion of the heating film, which is roughly 145 mm from the referential line C, becomes the highest in temperature. Further, in a case where a sheet of recording medium which is A5 in size is conveyed through the fixing device in the portrait mode (148 mm in sheet path width), the portion of the heating film, which is roughly 112 mm from the referential line C, becomes the highest in temperature.

Referring to Table 1, the heating (fixing) operation duration coefficient for the sheet path is set to 1.0, whereas the heating (fixing) operation duration coefficient for the portion of the out-of-sheet-path area, which is thought to become highest in temperature (largest in amount of frictional wear (deterioration)) is set to be largest (3.0). Further, as for the heating (fixing) operation duration coefficients for the portions of the out-of-sheet-path areas, which are not thought to become highest in temperature, their heating (fixing) operation duration coefficients are set so that the greater they are in the amount of the subsequent temperature increase, the greater (but, smaller than 3.0) they are in heating (fixing) operation duration coefficient.

By the way, referring to Table 1, the relationship between the recording medium size and sheet path width is as follows. In a case where recording medium is a sheet of paper which is A4 in size (210 mm×297 mm), and is conveyed in the landscape mode, the sheet path width (central conveyance) is 297 mm. In a case where the recording medium is a sheet of paper which is also A4 in size, but is conveyed in the portrait mode, the sheet path width is 210 mm (central conveyance). Further, in a case where recording medium is a sheet of paper which is of the letter size (LTR paper) (216 mm×279 mm), and is conveyed in the landscape mode, the sheet path width (central conveyance) is 279 mm. In a case where the recording medium is a sheet of paper which is also of the letter size (LTR paper), but is conveyed in the portrait mode, the sheet path width is 216 mm (central conveyance).

Further, in a case where recording medium is a sheet of paper which is A5 in size (148 mm×210 mm), and is conveyed in the landscape mode, the sheet path width (central conveyance) is 210 mm. In a case where the recording medium is a sheet of paper which is also A5 in size, but is conveyed in the portrait mode, the sheet path width is 148 mm (central conveyance).

Regarding the operation of the means for determining the length of the residual life span of the fixing device, first, the heating (fixing) operation duration calculating means 44 (obtaining portion) calculates the heating (fixing) operation duration for each of the aforementioned sections 1-5, based on a combination of the heating (fixing) operation duration coefficient selected by the heating (fixing) operation duration coefficient selecting means 42, and the output of the heating (fixing) operation duration counter 43, with the use of the following Formula 1. The length of the heating (fixing) operation is the information regarding the length of residual life of fixing device.

$$\text{Heating(fixing)operation duration count (section } A\text{)} = \text{heating(fixing)operation duration coefficient (section } A\text{)} \times \text{Operation length} \quad (1).$$

A stands for 1, 2, 3, 4 or 5. The length of operation is the same for all sections.

The heating (fixing) operation duration count obtained for each section for each image forming operation (each job) through the above-described process is cumulatively stored in a memory.

Next, the cumulative heating (fixing) operation duration count calculated for each section by the cumulative heating (fixing) operation duration count calculating means 44 is sent to the residual life span length determining means 45, and is compared with the preset value, which is a referential value for determining (deciding) whether or not the fixing device has reached the end of its life span. If it is determined by the residual life span length determining means 45 that some of the sections 1-5 have exceeded the value preset as the expected length of the life span of the fixing device, the residual life span displaying means 45 informs a user that the fixing device has reached the end of its life span. That is, the heating (fixing) operation duration count calculating means 44 obtains a value which is obtainable by multiplying the length of time the fixing device is used for each job, by the heating (fixing) operation duration coefficient which is preset for each section according to recording medium size and the position of each section. Then, it compares the obtained cumulative value for each section with the preset value (threshold value). If it determines that one of the sections is greater in the cumulative heating (fixing) operation duration length than the threshold value, it informs a user that the fixing device has reached the end of its life span.

If it determines that there is no section, the cumulative heating (fixing) operation duration count of which has exceeded the preset value, the heating (fixing) operation duration count calculating means 44 obtains the usage ratio (%) with the use of the following Formula (2), and displays the value of the section which is highest in usage ratio. By the way, it may display the residual life span ratio (100%-usage ratio).

$$\text{Usage ratio(section } A\text{)} = \text{cumulative heating (fixing) operation duration count(section } A\text{)} \div \text{life span value} \quad (2)$$

A stands for 1, 2, 3, 4 or 5.

By the way, the life span value is the same for all sections. However, it may be individually set for each section.

Next, one of the examples of the method for counting the length of the residual life of the fixing device is described. In the case of the fixing device in this embodiment, its life span in terms of sheet count is set to 540,000. In a case where the cumulative length of time sheets of recording paper which are A4 in size are conveyed through the fixing device is 250,000 seconds in the landscape mode; the cumulative length of time sheets of recording paper which is LTR size conveyed through the fixing device is 50,000 seconds; and the cumulative length of time sheets of recording paper which are A5 in size are conveyed through the fixing device is 80,000 seconds, the cumulative heating (fixing) operation duration count for each of the five sections is as shown in Table 2. In this case, the cumulative heating (fixing) operation duration count of the section 4 and that of the section 5 exceeded the life span count. Therefore, the residual life span displaying means displays that the fixing device reached the end of its life span.

TABLE 2

| Sheet Size | Operation Time | Counts Area 1 | Area 2 | Area 3 | Area 4 | Area 5 |
|---|---|---|---|---|---|---|
| A4 Landscape | 250000 | 250000 | 250000 | 250000 | 250000 | 250000 |
| LTR Landscape | 50000 | 150000 | 50000 | 50000 | 50000 | 50000 |
| A5 Portrait | 80000 | 80000 | 80000 | 104000 | 240000 | 240000 |
| Cumulative count | | 480000 | 380000 | 404000 | 540000 | 540000 |
| Lives | | remains | remains | remains | ended | ended |
| Usage ratio | | 89% | 70% | 75% | 100% | 100% |

Next, the method for determining the length of the residual life span of the fixing device in this embodiment is described in greater detail. In this embodiment, the length of the residual life span of the fixing device is determined based on the degree of the frictional wear (deterioration) of the surface layer of the heating film 101 and that of the pressure roller 104. There is a correlation between the amount of the frictional wear (deterioration) of the surface layer of the heating film 101 (as well as pressure roller 104) and the surface temperature of the heating film 101 (pressure roller 104). There is also a correlation between the amount of the frictional wear (deterioration) of the surface layer of the heating film 101 (as well as pressure roller 104) and the length of time the surface layer rubbed against the object which the heating film 101 (pressure roller 104) opposes, that is, the length of time (distance) the heating film 101

(pressure roller 104) was in a heating (fixing) operation. Thus, the thermal deterioration starts across the section which is highest temperature, and progresses onto the sections which are lower in temperature. That is, the higher in surface temperature a given section of the heating film 101 and/or pressure roller 104, the greater it is in the amount of the frictional wear (deterioration).

The outermost layer of the heating film 101 as a heating member, and that of the pressure roller 104, are formed of fluorine resin, which is more likely to reduce in strength, being therefore more likely to be susceptible to frictional wear (deterioration) when such energy as the thermal energy given thereto by heating and/or the mechanical energy given thereto by the friction between the fixing members of the fixing device is larger than when the energy is smaller.

Figure 5:
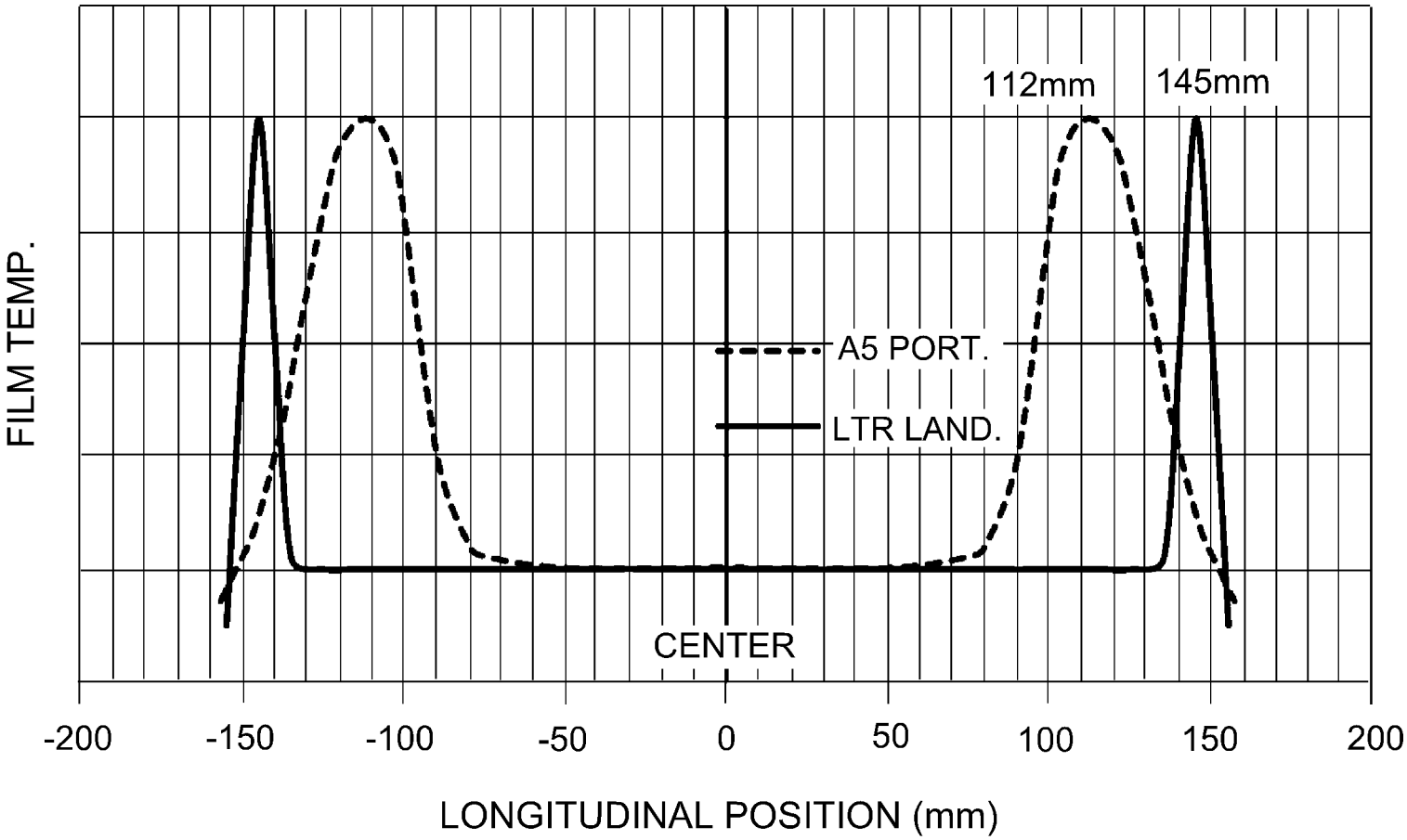
FIG. 5 is a graph which shows the temperature distribution of the fixation film of the fixing device, in terms of the lengthwise direction of the fixing device, in the first embodiment.

As described above, FIG. 5 shows the distribution of the surface temperature of the heating film 101 with respect to the lengthwise direction of the fixing device. The fixing device in this embodiment is enabled to accommodate as large a sheet of recording medium as a sheet of recording paper of size A4 (297 mm in path width). Therefore, in a case where a sheet of recording paper, which is narrower than the sheet path of the widest sheet of recording paper (of LTR size and A5 size) which the fixing device can accommodate, is conveyed through the fixing device for thermal fixation, the portions of the heating film 101 and those of the pressure roller 104, which are outside the recording medium path, increase in temperature, because the heat given to these portions are not consumed. That is, these portions increase in temperature as shown in FIG. 5 (temperature increase of out-of-sheet-path portions).

The fixing device in this embodiment is of the so-called film heating type. It employs a heating film which is substantially smaller in thermal capacity than any conventional heating film. Thus, it is likely to be greater in the amount of difference in temperature between the sheet path portion and out-of-sheet-path portions of the heating film 101, and that between the sheet path portion and out-of-sheet-path portions of the pressure roller 104. In a case where a heating member such as the one in this embodiment, which is small in thermal capacity, is employed, it takes a very short length of time for the heat from the heater to be supplied to the recording medium from the sheet path portion of the heating film 101. Thus, the out-of-sheet-path portions of the heating film 101 and those of the pressure roller 104 become higher in temperature faster than in a case where a film which is greater in thermal capacity than that used in this embodiment is employed. Thus, the difference in temperature between the portions of the heating film 101, which are out of the sheet path, and the portion of the heating film 101, which is in the sheet path, is likely to become rather large, and so is the difference in temperature between the portions of the pressure roller 104, which are out of the sheet path, and the portion of the pressure roller 104, which is in the sheet path.

In this embodiment, however, one of the lengthwise end portions of the fixing device is divided into multiple sections for determining the length of the residual life span of the fixing device, and each section is determined in the length of residual life span. Thus, even if sheets of recording medium which are different in size are conveyed in mixture through the fixing device, it is possible to determine the degree of frictional wear of each section. Therefore, the residual life span of the fixing device in this embodiment can be more accurately determined.

By the way, the material for the heating film 101 is not limited to the above-described one used in this embodiment. For example, a metallic sleeve (cylindrical film), the substrative layer of which is film which is made of a metallic substances such as SUS, Al, Ni, Cu, Zn or the like, which is heat resistant and high in thermal conductivity, and which is no more than 100 μm in thickness, or film which is made of alloy of these metallic substances, and which is no more than 100 μm in thickness, may be used as the material for the heating film 101. Further, heat resistant polyimide film which is no more than 100 μm, preferably, no more than 50 μm and no less than 20 μm, in thickness may be used as the material for the heating film 101.

As described above, in this embodiment, the length of the residual life span of the fixing device is determined based on the degree of frictional wear of the surface layer of the heating film 101 and/or the degree of frictional wear of the surface layer of the pressure roller 104. There is a correlation between the amount of the frictional wear of the surface layer of the heating film 101 (and pressure roller 104) and the surface temperature of the heating film 101 (and pressure roller 104), and between the amount of the frictional wear of the surface layer of the heating film 101 (pressure roller 104) and the length of time the surface layer of the heating film 101 (pressure roller 104) rubbed against the surface of the opposing member. That is, the frictional wear begins across the section which is the highest in surface temperature, and then, sequentially spreads toward the sections which are lower in surface temperature. In this embodiment, therefore, the length of the residual life span of each of the multiple sections, into which one of the lengthwise end portions of heating film 101 and pressure roller 104 are divided, can be determined based on the difference in the amount of the frictional wear, which is related to recording medium size, can be determined. Thus, even if multiple sheets of recording medium, which are different in size, are conveyed in mixture, the state of the frictional wear of each section can be individually determined. Therefore, it is possible to improve a image forming apparatus (fixing device) in the accuracy with which the length of the residual life span of the fixing device can be determined.

Embodiment 2

Next, the second embodiment of the present invention is described. The members of the fixing device in this embodiment, and the portions thereof, which are the same as the counterparts in the first embodiment are given the same referential codes as those given to the counterparts, and are not described. Also in this embodiment, the effect of the heating (fixing) operation upon each of the multiple sections, into which one of the lengthwise ends of heating film 101 and pressure roller 104 are divided to determine the length of the residual life span of the fixing device (heating film 101 and that of the pressure roller 104), is calculated, and the length of the residual life span of the fixing device is determined based on the value obtained by the calculation. In this embodiment, however, the fixing device is provided with a thermistor as a temperature detecting member for detecting the temperature of one of the lengthwise end portions of the fixing device, and the heating (fixing) operation duration coefficient in the mathematical formula (Formula 1 in first embodiment) for calculating the heating (fixing) operation duration is changed according to the recording medium size and the detected temperature.

That is, in this embodiment, the heating (fixing) operation duration count is calculated by multiplying the cumulative length of usage (heating) of each section, by the coefficient set for each section based on the size of recording medium, with respect of the lengthwise direction, and the output of the temperature detecting means.

Figure 6:
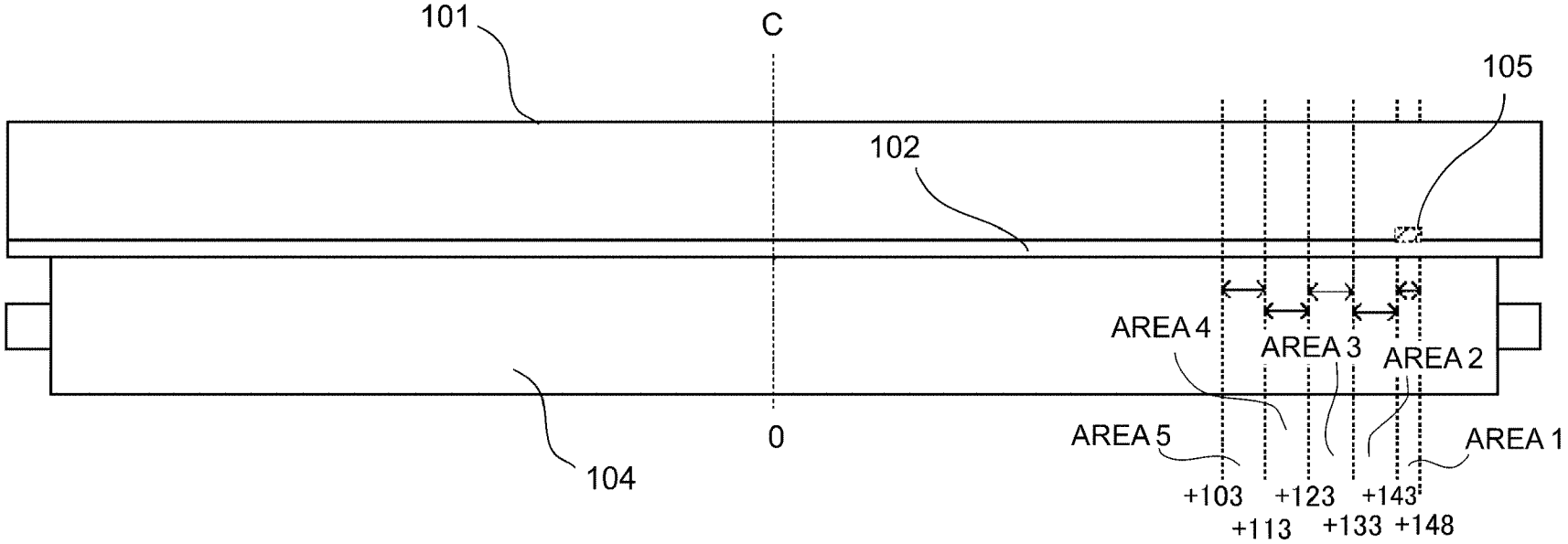
FIG. 6 is a schematic side view of the fixing device in the second embodiment of the present invention, as seen from the direction perpendicular to the lengthwise direction of the apparatus; it shows the general structure of the apparatus.

FIG. 6 shows the life span calculation sections into which one of the lengthwise end portions of the heating film 101 and one of the lengthwise ends of the pressure roller 104 of the fixing device were divided, and the thermistor 105 which is disposed in contact with the surface of the heating member. The thermistor 105 is not placed in contact with the heating film 101, and is positioned 145 mm from the sheet conveyance referential line C.

Figure 7:
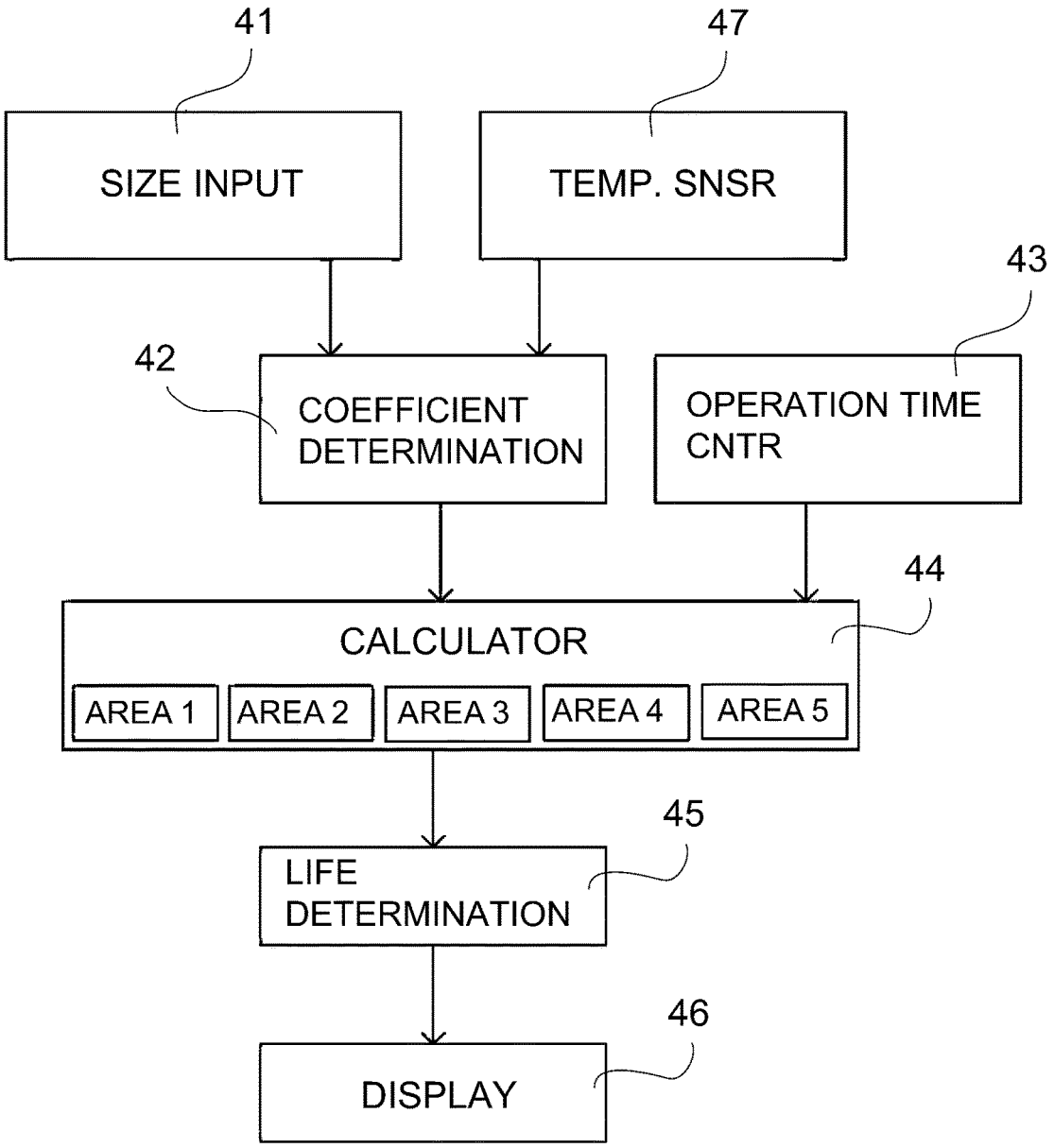
FIG. 7 is a block diagram of a means for determining the length of the residual life span of the fixing device, in the second embodiment.

FIG. 7 is a block diagram of the residual life span determining means in this embodiment. A referential code 41 stands for a recording medium size inputting means, through which the recording medium size information is inputted into the image forming apparatus from an external apparatus, such as a PC, or by way of the operation panel or the like of the image forming apparatus. A referential code 47 stands for a temperature detecting means, which detects the temperature of the heating member, based on the output of the thermistor 105 disposed in contact with the heating member. A referential code 42 stands for a heating (fixing) operation duration coefficient selecting means, which selects the heating (fixing) operation duration coefficient to be used for obtaining the cumulative length of the heating (fixing) operation, based on the recording medium size information and the output of the temperature detecting means 47.

A referential code 43 stands for a heating operation duration counter, which measures the length of time the motor for driving the pressure roller 104, as a pressing member, is driven. Further, a referential code 44 stands for a means for calculating the amount of the heating (fixing) operation duration of the fixing device (heating film 101 and/or pressure roller 104). The means 44 calculates the cumulative length of the heating (fixing) operation of the fixation apparatus, which indicates the cumulative length of time the fixing device was in a heating operation, based on the output from the heating (fixing) operation duration length counter 43 and the output from the heating (fixing) operation duration coefficient selecting means. A referential code 45 stands for a means for detecting the length of the residual life span of the fixing device, based on the cumulative length of the heating (fixing) operation duration count calculated by the heating (fixing) operation duration counting means 44. Further, a referential code 45 is a means for displaying the length of the residual life span of the fixing device. The means 45 informs a user that the cumulative usage of the fixing device is beyond its life expectancy.

Next, the operation of the residual life span length determining means in this embodiment is described in detail. As an image forming operation is started, the recording medium size inputting means 41 outputs the recording medium size information to the heating (fixing) operation duration coefficient selecting means 42. Further, the temperature detecting means 47 outputs to the heating (fixing) operation duration coefficient selecting means 42, the heater temperature obtained from the output of the thermistor 105. Then, the heating (fixing) operation duration coefficient selecting means 42 selects the heating (fixing) operation duration coefficient for each of the sections 1-5, based on the recording medium size information and detected temperature, with reference to Tables 3, 4 and 5, which show the relationship among the heating (fixing) operation duration coefficients, detected temperature, and position of each of the five sections for determining the heating (fixing) operation duration of the fixing device.

TABLE 3

| Sheet Size | Detected Temp. ° C. | Area 1 143-148 mm | Area 2 133-143 mm | Area 3 123-133 mm | Area 4 113-123 mm | Area 5 103-113 mm |
|---|---|---|---|---|---|---|
| LDR-Portrait LTR-Landscape | ≥270 | 3.0 | 1.0 | 1.0 | 1.0 | 1.0 |
| EXE-Landscape B4-Portrait B5-Landscape | ≥260 | 2.0 | 3.0 | 1.0 | 1.0 | 1.0 |
| LGL-Portrait LTR-Portrait A4-Portrait A5-Landscape | ≥250 | 1.0 | 2.0 | 3.0 | 1.0 | 1.0 |
| B5-Portrait B6-Landscape | ≥220 | 1.0 | 1.3 | 3.0 | 3.0 | 1.3 |
| A5-Portrait A6-Landscape | ≥220 | 1.0 | 1.0 | 1.3 | 3.0 | 3.0 |

TABLE 4

| Sheet Size | Detected Temp. ° C. | Area 1 143-148 mm | Area 2 133-143 mm | Area 3 123-133 mm | Area 4 113-123 mm | Area 5 103-113 mm |
|---|---|---|---|---|---|---|
| LDR-Portrait LTR-Landscape | ≥260 <270 | 2.0 | 1.0 | 1.0 | 1.0 | 1.0 |
| EXE-Landscape B4-Portrait B5-Landscape | ≥250 <260 | 1.3 | 2.0 | 1.0 | 1.0 | 1.0 |
| LGL-Portrait LTR-Portrait A4-Portrait A5-Landscape | ≥240 <250 | 1.0 | 1.3 | 2.0 | 1.3 | 1.0 |
| B5-Portrait B6-Landscape | ≥210 <220 | 1.0 | 1.0 | 2.0 | 2.0 | 1.0 |
| A5-Portrait A6-Landscape | ≥210 <220 | 1.0 | 1.0 | 1.0 | 2.0 | 2.0 |

TABLE 5

| Sheet Size | Detected Temp. ° C. | Area 1 143-148 mm | Area 2 133-143 mm | Area 3 123-133 mm | Area 4 113-123 mm | Area 5 103-113 mm |
|---|---|---|---|---|---|---|
| A3-Portrait A4-Landscape | any | 1.0 | 1.0 | 1.0 | 1.0 | 1.0 |
| LDR-Portrait LTR-Landscape | <260 | 1.0 | 1.0 | 1.0 | 1.0 | 1.0 |
| EXE-Landscape B4-Portrait B5-Landscape | <250 | 1.0 | 1.0 | 1.0 | 1.0 | 1.0 |
| LGL-Portrait LTR-Portrait A4-Portrait A5-Landscape | <240 | 1.0 | 1.0 | 1.0 | 1.0 | 1.0 |
| B5-Portrait B6-Landscape | <210 | 1.0 | 1.0 | 1.0 | 1.0 | 1.0 |
| A5-Portrait A6-Landscape | <210 | 1.0 | 1.0 | 1.0 | 1.0 | 1.0 |

In a case where recording medium which is A4, for example, in size is conveyed in the portrait mode, Table 3 shows the heating (fixing) operation duration coefficients when the detected temperature is 250° C.; Table 4 shows the heating (fixing) operation duration coefficient when the detected temperature is no less than 240° C. and no more than 250° C.; and Table 5 shows the heating (fixing) operation duration coefficients when the detected temperature is no more than 240° C.

Referring to FIG. 7 which shows the residual life span length determining means in this embodiment, the heating (fixing) operation duration calculating means 44 calculates cumulative heating (fixing) operation duration count for each of the sections 1-5, based on the output of the heating (fixing) operation duration count coefficient selecting means 42 and that of the heating (fixing) operation duration counter 43, with the use of the aforementioned Formula (1). The heating (fixing) operation duration count is cumulatively stored as cumulative heating (fixing) operation duration count in a memory, for each section, each time an image forming operation is carried out.

The cumulative heating (fixing) operation duration count calculated for each section by the cumulative heating (fixing) operation duration calculating means is compared with the preset referential value set as the expected life span of the fixing device. In a case where the cumulative length of the usage of any section exceeds the preset value, the residual life span length information displaying means 45 informs a user that the fixing device has reached the end of its life span. In a case where there is no section which has reached the preset value for the expected life span of the fixing device, the residual life span length displaying means 45 displays the largest of the usage ratios obtained with the use of the aforementioned Formula (2).

As described above, in this embodiment, the length of the residual life span of the fixing device is determined based on the degree of the frictional wear of the surface layer of the heating film 101 and that of the pressure roller 104. There is a correlation between the amount of the frictional wear of the surface layer of the heating film 101, and the surface temperature of the heating film 101, and also, there is a correlation between the amount of frictional wear of the surface layer of the heating film 101, and the length of time (distance) the heating film 101 rubbed the object which opposes the heating film 101. Further, there is a correlation between the amount of the frictional wear of the surface layer of the pressure roller 104, and the surface temperature of the pressure roller 104, and also, there is a correlation between the amount of the frictional wear of the surface layer of the pressure roller 104, and the length of time (distance) the pressure roller 104 rubbed the object which opposes the pressure roller 104. That is, the frictional wear starts on the section which is highest in surface temperature, and then, sequentially progresses onto the sections which are lower in the surface temperature. Further, in this embodiment, the length of residual life span of each of the sections of one of the lengthwise end portions of the fixing device, which is for determining the length of residual life span of the fixing device, is determined according to the difference in the degree of frictional wear, which is determined according to recording medium size and detected temperature. Thus, even in a case where sheets of recording medium, which are different in size, are conveyed in mixture, the state of frictional wear of each section can be individually detected. Therefore, it is possible to improve an image forming apparatus in the accuracy with which it can determine the length of residual life span of its fixing device.

By the way, in this embodiment, the temperature detecting means was disposed in contact with the heater. However, it may be disposed to detect the temperature of the heating film, which is a heating member (rotational member), and/or that of the pressure roller 104 which is a pressing member (member which opposes heating film 101), etc.

Embodiment 3

Next, the third embodiment of the present invention is described. The members of the fixing device, and the portions thereof, in this embodiment, which are the same as the counterparts in the first embodiment are given the same referential codes as those given to the counterparts, and are not described here. As in the first embodiment, one of the lengthwise end portions of the fixing member is divided into multiple (5) sections, with respect to the lengthwise direction, which are used for determining the length of the residual life span of the fixing device. The state of the thermal deterioration is calculated for each section, and the length of the residual life span of the fixing device is determined based on the calculated state of the thermal deterioration of each section. In this embodiment, however, the image forming apparatus is provided with a print count detecting means, and the coefficient in mathematical formula (Formula (1)) in first embodiment) for calculating the cumulative length of the heating (fixing) operation of the fixing device was changed, according to the recording medium size and print count.

That is, in this embodiment, the heating (fixing) operation duration count is obtained by multiplying the cumulative heating operation duration by the coefficient set for each section, based on the recording medium size information, with respect to the lengthwise direction of the fixing device, and the output of the print count detecting means.

Figure 8:
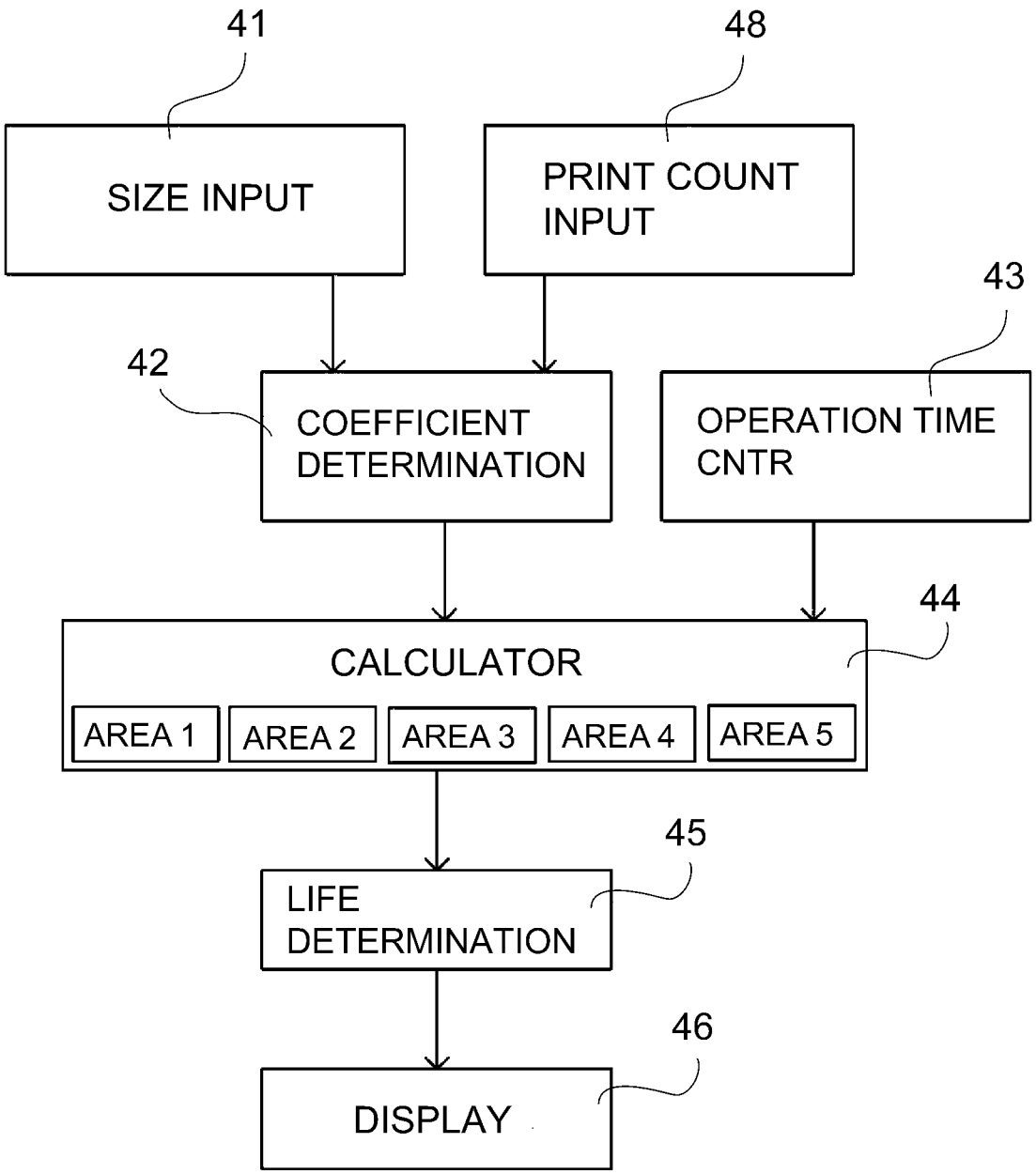
FIG. 8 is a block diagram of a means for determining the length of the residual life span of the fixing device, in the third embodiment of the present invention.

FIG. 8 is a block diagram of the residual life span length determining means in this embodiment. A referential code 41 stands for a recording medium size inputting mean, which is for inputting recording medium size information into the image forming apparatus, with the use of the control panel of an external apparatus such as a PC, or that of the image forming apparatus. A referential code 48 stands for a print count inputting means, which is for inputting the count by which images are to be formed, with the use of the control panel or the like of an external apparatus such as a PC, or that of the image forming apparatus.

A referential code 42 stands for a means for selecting the coefficient for heating (fixing) operation duration. The means 42 selects a coefficient for calculating the cumulative heating (fixing) operation duration count, based on the recording medium size sent from the recording medium size inputting means 41, and the print count information sent from the print count inputting means 48. A referential code 43 stands for a heating (fixing) operation duration counter, which is a means for counting the length of time the motor for driving the pressure roller 104, as a pressing means, is rotated.

A referential code 44 stands for a means for calculating the heating operation duration count. The means 44 is for calculating the cumulative heating (fixing) operation duration count, which indicates the state of the thermal deterioration of the fixing device, based on the output of the means 42 for selecting a coefficient for calculating the heating (fixing) operation duration, and the output of the heating (fixing) operation duration counter 43. Further, a referential code 45 stands for a residual life span length determining means. The means 45 determines the length of the residual life span of the fixing device, based on the cumulative heating (fixing) operation duration count calculated by the heating (fixing) operation duration count calculating means 44. A referential code 46 stands for a residual life span length displaying means, which is for informing a user that the cumulative length of time the fixing device was used for thermal fixation has exceeded the expected length of its life span.

Next, the operational sequence, in this embodiment, for determining the length of the residual life span of the fixing device is described in detail. First, the recording medium size inputting means 41 outputs the recording medium size information to the heating (fixing) operation duration coefficient selecting means 41. Further, the print count inputting means 48 outputs to the heating (fixing) operation duration coefficient determining means 42, the count of the prints which are to be continuously outputted by a given job. Here, the heating (fixing) operation duration coefficient selecting means 42 selects the coefficient for each of the sections 1-5, with reference to Tables 6, 7 and 8, which shows the relationship among the recording medium size, print count, sections, and coefficients.

TABLE 6

| Sheet Size | Print Count | Area 1 143-148 mm | Area 2 133-143 mm | Area 3 123-133 mm | Area 4 113-123 mm | Area 5 103-113 mm |
|---|---|---|---|---|---|---|
| LDR-Portrait LTR-Landscape | ≥20 | 3.0 | 1.0 | 1.0 | 1.0 | 1.0 |
| EXE-Landscape B4-Portrait B5-Landscape | ≥20 | 2.0 | 3.0 | 1.0 | 1.0 | 1.0 |
| LGL-Portrait LTR-Portrait A4-Portrait A5-Landscape | ≥20 | 1.0 | 2.0 | 3.0 | 1.0 | 1.0 |
| B5-Portrait B6-Landscape | ≥20 | 1.0 | 1.3 | 3.0 | 3.0 | 1.3 |
| A5-Portrait A6-Landscape | ≥20 | 1.0 | 1.0 | 1.3 | 3.0 | 3.0 |

TABLE 7

| Sheet Size | Print Count | Area 1 143-148 mm | Area 2 133-143 mm | Area 3 123-133 mm | Area 4 113-123 mm | Area 5 103-113 mm |
|---|---|---|---|---|---|---|
| LDR-Portrait LTR-Landscape | ≥10 | 2.0 | 1.0 | 1.0 | 1.0 | 1.0 |
| EXE-Landscape B4-Portrait B5-Landscape | ≥10 | 1.3 | 2.0 | 1.0 | 1.0 | 1.0 |
| LGL-Portrait LTR-Portrait A4-Portrait A5-Landscape | ≥10 | 1.0 | 1.3 | 2.0 | 1.3 | 1.0 |
| B5-Portrait B6-Landscape | ≥10 | 1.0 | 1.0 | 2.0 | 2.0 | 1.0 |
| A5-Portrait A6-Landscape | ≥10 | 1.0 | 1.0 | 1.0 | 2.0 | 2.0 |

TABLE 8

| Sheet Size | Print Count | Area 1 143-148 mm | Area 2 133-143 mm | Area 3 123-133 mm | Area 4 113-123 mm | Area 5 103-113 mm |
|---|---|---|---|---|---|---|
| A3-Portrait A4-Landscape | any | 1.0 | 1.0 | 1.0 | 1.0 | 1.0 |

TABLE 8-continued

| Sheet Size | Print Count | Area 1 143-148 mm | Area 2 133-143 mm | Area 3 123-133 mm | Area 4 113-123 mm | Area 5 103-113 mm |
|---|---|---|---|---|---|---|
| LDR-Portrait LTR-Landscape | <10 | 1.0 | 1.0 | 1.0 | 1.0 | 1.0 |
| EXE-Landscape B4-Portrait B5-Landscape | <10 | 1.0 | 1.0 | 1.0 | 1.0 | 1.0 |
| LGL-Portrait LTR-Portrait A4-Portrait A5-Landscape | <10 | 1.0 | 1.0 | 1.0 | 1.0 | 1.0 |
| B5-Portrait B6-Landscape | <10 | 1.0 | 1.0 | 1.0 | 1.0 | 1.0 |
| A5-Portrait A6-Landscape | <10 | 1.0 | 1.0 | 1.0 | 1.0 | 1.0 |

Table 6 represents a case in which the print count is no less than 20, and Table 7 represents a case where the print count is no less than 10 and no more than 20. Table 8 represents a case where the print count is no more than 10.

Next, the heating (fixing) operation duration count calculating means 44 calculates the cumulative heating (fixing) operation duration count for each of the sections 1-5 based on the output of the heating (fixing) operation duration counter 43, with the use of the aforementioned Formula (1). The thus obtained heating (fixing) operation duration count obtained for each section, in each image forming operation, is cumulatively stored in a memory.

Next, the cumulative heating (fixing) operation duration count obtained for each section by the heating (fixing) operation duration counting means 44 is compared with the preset referential value (life span count). If there is a section, the length of the residual life span of which is greater than the preset referential value, the residual life span length displaying means 46 informs a user that the fixing device has reached the end of its life span. If there is no section, the length of the residual life span of which has reached the preset referential value, the residual life span length displaying means displays the largest of the usage ratio obtained with the use of the abovementioned mathematical formula (Formula (2)).

In this embodiment, the coefficient to be used by the heating (fixing) operation duration counting means 44 is changed according to the number of the prints which are to be continuously printed in a given job. As a substantial number of prints are continuously outputted by an image forming apparatus, the out-of-sheet-path portions of the fixing device significantly increase in temperature. Therefore, the state of the out-of-sheet-path portions of the fixing device can be more precisely determined by changing the coefficient according to the print count.

As described above, in this embodiment, the length of the residual life span of the fixing device is determined based on the degree of the frictional wear of the surface layer of the heating film 101 and that of the pressure roller 104. Further, the length of the residual life span of each section of one of the lengthwise end portions of the heating film 101 and that of the pressure roller 104, can be determined in consideration of the fact that the degree of the frictional wear of the surface layer of the heating film 101 and that of the pressure roller 104 are affected by the recording medium size and print count. Thus, even in a case where a substantial number of sheets of recording medium, which are different in size, are conveyed in mixture, the state of the frictional wear of each section can be individually determined. Therefore, the length of the residual life span of the fixing device can be more accurately determined than in the past.

Modified Versions of Preceding Embodiments

In the foregoing, a couple of the preferred embodiments of the present invention were described. These embodiments, however, are not intended to limit the present invention its scope. That is, the present invention is also applicable to various modified versions of image forming apparatus (fixing device) within the scope of the present invention.

(Modification 1)

In the embodiments described above, the fixing device was provided with the first and second rotational members, and an endless belt fitted around the first rotational member. However, it may be around the second rotational member that the endless belt is fitted. Moreover, the fixing device may be provided with the first and second rotational members, and a pair of endless belts fitted around the first and second rotational members, one for one. Further, the heat source does not need to be an ordinary electric heater. For example, a heating means based on electromagnetic induction may be employed in place of the ordinary electric heater.

Further, an image forming apparatus and its fixing device may be structured so that as the cumulative length of time the fixing device has been in operation has exceeded the expected length of its life span, its can be replaced in entirety, or only a part (endless belt, for example) or parts of it, which are necessary to be replaced, can be replaced. In the preferred embodiments described above, one of the lengthwise end portions of the heating film and that of the pressure roller of the fixing device were divided into multiple sections, and whether or not each section has reached the end of its life span was determined based on the estimated amount of frictional wear which each section of the heating film 101 and that of the pressure roller 104, that is, that of the member which opposes the heating member, sustained. However, an image forming apparatus may be designed so that the length of the residual life span of its fixing device is determined based on the length of the residual life span of at least one of the rotational members.

(Modification 2)

In the preferred embodiment of the present invention described above, the recording medium was a sheet of recording paper. However, the preceding embodiments are not intended to limit the present invention in its scope. Generally speaking, recording medium is a sheet made of a certain substance, on which a toner image can be formed by an image forming apparatus. For example, it includes a sheet of ordinary paper, cardstock, thin paper, an envelop, a postcard, a seal, a sheet of resinous substance, a sheet of OHP film, a sheet of glossy paper, etc. By the way, in the embodiments described above, handling of a sheet P of recording medium was described with the use of such terminologies as "paper conveyance, paper discharge, paper feeding, paper feeding portion, out-of-sheet-path portion of paper, etc.". However, these embodiments are not intended to limit the present invention in its scope in terms of recording medium selection.

(Modification 3)

In the embodiments of the present invention described above, the fixing device was an apparatus for fixing an unfixed toner image to a sheet of recording medium. However, these embodiments are not intended to limit the present invention in scope. That is, the present invention is also applicable to an apparatus (which also is referred to as fixing device) for applying heat and pressure to a temporarily fixed image on a sheet of recording medium, to increase the image in glossiness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-242008 filed on Dec. 14, 2016, which is hereby incorporated by reference herein in its entirety.

What is claimed is:

1. An image forming apparatus comprising:

an image forming portion configured to form a toner image on a recording material;

a fixing portion configured to fix the toner image on the recording material, said fixing portion including a first rotatable member and a second rotatable member cooperative with said first rotatable member to form a nip, wherein the recording material carrying the toner image is subjected to a fixing process by passing through the nip so that the toner image is fixed on the recording material;

an obtaining portion configured to obtain information relating to remaining service life of each area provided by dividing said first rotatable member into a plurality of areas in a longitudinal direction of said first rotatable member; and an informing portion configured to inform a remaining service life of said fixing portion or said image forming apparatus in accordance with the information obtained by said obtaining portion, wherein the information is provided by accumulating values each obtained, for each image formation job, by multiplying a time period of said fixing process by an operation coefficient determined on the basis of a size of the recording material and a position of the area.

2. The apparatus according to claim 1, wherein the time period is a rotation period of said first rotatable member in the fixing process.

3. The apparatus according to claim 1, wherein said fixing portion is provided with a temperature detecting member configured to detect a temperature of said first rotatable member, and wherein the operation coefficient at a time when a detected temperature of said temperature detecting member is higher than a predetermined temperature is larger than that of a time when the detected temperature of said temperature detecting member is lower than the predetermined temperature.

4. The apparatus according to claim 1, wherein said informing portion informs the remaining service life of said fixing portion or said image forming apparatus when the cumulated value for an area exceeds a threshold.

5. The apparatus according to claim 1, wherein the first rotatable member is a cylindrical film.

6. A method of discriminating a residual life span of a first rotatable member of an image fixing apparatus including the first rotatable member and a second rotatable member which form a nip through which a recording material carrying a toner image is passed so that the recording material is heated to fix the toner image on the recording material, said method comprising:

setting a fixing operation duration coefficient of a first area provided by dividing said first rotatable member into a plurality of areas in a longitudinal direction of said first rotatable member when a size of the recording material is a first size, and a fixing operation duration coefficient of a second area provided at a different position from the first area in a longitudinal direction of said first rotatable member when the size of the recording material is the first size;

obtaining an operation length of a fixing operation when the size of the recording material is the first size;

calculating a fixing operation duration count of the first area when the fixing operation is carried out for the recording materials of the first size, in accordance with the fixing operation duration coefficient of the first area when the size of the recording material is the first size, and the operation length of the fixing operation when the size of the recording material is the first size;

calculating a fixing operation duration count of the second area when the fixing operation is carried out for the recording materials of the first size, in accordance with the fixing operation duration coefficient of the second area when the size of the recording material is the first size, and the operation length of the fixing operation when the size of the recording material is the first size;

storing, in a memory, the fixing operation duration count of the first area and the fixing operation duration count of the second area when the size of the recording material is the first size;

setting a fixing operation duration coefficient of the first area when the size of the recording material is a second size, and a fixing operation duration coefficient of the second area when the size of the recording material is the second size;

obtaining an operation length of the fixing operation when the size of the recording material is the second size;

calculating a fixing operation duration count when the fixing operation is carried out for the recording materials of the second size, in accordance with the fixing operation duration coefficient of the first area when the size of the recording material is the second size, and the operation length of the fixing operation when the size of the recording material is the second size;

calculating a fixing operation duration count when the fixing operation is carried out for the recording materials of the second size, in accordance with the fixing operation duration coefficient of the first area when the size of the recording material is the second size, and the operation length of the fixing operation when the size of the recording material is the second size;

adding the fixing operation duration count of the first area when the size of the recording material is the second size and the fixing operation duration count, stored in the memory, of the first area when the size of the recording material is the first size, and adding the fixing operation duration count of the second area when the size of the recording material is the second size and the fixing operation duration count, stored in the memory, of the second area when the size of the recording material is the first size;

comparing the added fixing operation duration count of the first area and the added fixing operation duration count of the second area with a reference value relating to the residual life span; and discriminating an end of the residual life span when the fixing operation duration count of at least one of the first area and the second the area reaches the reference value.

7. The method according to claim 6, wherein the first rotatable member is a cylindrical film.

* * * * *